US006328378B1

(12) United States Patent
Erickson

(10) Patent No.: US 6,328,378 B1
(45) Date of Patent: Dec. 11, 2001

(54) PORTABLE ROCKING CHAIR CONVERSION APPARATUS

(76) Inventor: Rachel Frances Erickson, 404 Wilderness Trail, Frederic, WI (US) 54837

( * ) Notice: Subject to any disclaimer, the term of this patent is extended or adjusted under 35 U.S.C. 154(b) by 0 days.

(21) Appl. No.: 09/670,158

(22) Filed: Sep. 26, 2000

(51) Int. Cl.[7] ..... A47C 13/00
(52) U.S. Cl. ..... 297/133; 52/272.1; 52/271.6
(58) Field of Search ..... 297/271.6, 272.1, 297/133

(56) References Cited

U.S. PATENT DOCUMENTS 264,917 * 9/1882 Andrews ..... 297/133
1,317,580 * 9/1919 Kanode ..... 297/133
1,367,390 * 2/1921 Hinson ..... 297/133
6,086,147 * 7/2000 Gladstone ..... 297/133

* cited by examiner

*Primary Examiner*—Carl D. Friedman
*Assistant Examiner*—Dennis L. Dorsey
(74) *Attorney, Agent, or Firm*—John D. Gugliotta

(57) ABSTRACT

An apparatus is provided by which an attachable, telescopic, bowed rocking chair members are provided to convert a conventional chair into a rocking chair. Horizontally adjustable impingement cylinders are also provided for frictionally gripping legs of a chair. Being telescopic in design, the present invention is easily transportable.

12 Claims, 2 Drawing Sheets

PORTABLE ROCKING CHAIR CONVERSION APPARATUS

RELATED APPLICATIONS

The present invention was first described in Disclosure Document No. 471,794 filed on Apr. 3, 2000. There are no previously filed, nor currently any co-pending applications, anywhere in the world.

BACKGROUND OF THE INVENTION

1. Field of the Invention

The present invention relates generally to rocking devices for conventional chairs and, more particularly, to a portable rocking chair conversion apparatus.

2. Description of the Related Art

Just about everyone has sat in a rocking chair at one time or another. They are enjoyed by people of all ages for their ability to increase relaxation and reduce stress. Additionally, the rhythmic motion along with any repetitive creaks that they make while rocking is just about to put all but the toughest insomniac to sleep. However, there are times when a person's favorite rocking chair may not be handy. This will most likely occur while traveling, such as when staying at a hotel. Ironically, it is times like these that the comfort of a rocking chair is most needed, especially if traveling with an infant who is uncomfortable with the new surroundings or even an adult who may have difficulty falling asleep in a strange place.

A search of the prior art did not disclose any patents that read directly on the claims of the instant invention; however, the following references were considered related. The following patents disclose a modular chair construction: U.S. Pat. No. 5,979,988 issued in the name of Heidmann et al.; U.S. Pat. No. 5,873,634 issued in the name of Heidmann et al.; and U.S. Pat. No. 5,782,536 issued in the name of Heidmann et al.

The following patents describe a chair-to-rocking chair conversion unit: U.S. Pat. No. 5,833,307 issued in the name of Leach et al.; U.S. Pat. No. 5,486,034 issued in the name of Dalke; and U.S. Pat. No. 4,126,353 issued in the name of Clough.

The following patents disclose the design and function for a rocker attachment: U.S. Pat. No. 5,702,152 issued in the name of Shaw, U.S. Pat. No. 1,231,151 issued in the name of Gerrard, Jr.; U.S. Pat. No. 145,036 issued in the name of Wilcox et aL; and U.S. Pat. No. D 380,633 issued in the name of Shaw.

U.S. Pat. No. 5,660,431 issued in the name of Leach describes a rocker conversion for lawn-type chairs.

Consequently, a need has been felt for providing a device which allows for a standard, conventional chair to provide the soothing comfort of rocking in a rocking chair almost anywhere in a manner which is quick, easy, portable and efficient.

SUMMARY OF THE INVENTION

Therefore, it is an object of the present invention to provide a portable rocking chair conversion apparatus which allows any chair with legs to be converted into a rocking chair.

It is another object of the present invention to provide a device which readily adapts to chairs of various sizes.

It is still another object of the present invention to provide a retractable, lightweight device which is easily transportable.

It is still another object of the present invention to provide a device which easily converts conventional chairs to rocking chairs without tools.

Briefly described according to one embodiment of the present invention, a portable rocking chair conversion apparatus is provided for converting any conventional chair into a rocking chair. A pair of arcuate, cylindrical, telescoping rocking members provide a retractable device being easily transportable.

Each of the rocking members are held into their desired position via a spring-loaded pin assembly.

A leg attachment means is disclosed for securely accommodating legs of a chair. The leg attachment means includes a plurality of selectably adjustable impingement cylinders having a frictional gripping slot formed on an upper, external circumferential surface thereof for removably receiving a chair leg. The frictional gripping slot is adapted so as to conform to and securely grip an inserted chair leg. Such design allows the frictional gripping slot to grippingly receive chair legs formed not only in circular shapes having a particular diameter, but in cross-sectional shapes such as square and hexagonal having various diameters as well.

To accommodate chairs of various sizes, bolts are attached at ends of each of the cylinders for slidably engaging slots formed along opposing vertical sidewalls of each of the rocking members. The ends of the cylinders are operable to slide within and along the slots thereby allowing for the selective adjustment of the cylinders for accommodating chairs of various sizes. Fasteners are secured to the bolts for locking each of the cylinders in place once a desired position is provided.

The use of the present invention allows for a conventional chair to provide the soothing comfort of rocking in a rocking chair almost anywhere in a manner which is quick, easy, portable and efficient.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENT

1. Detailed Description of the Figures

Figure 1:
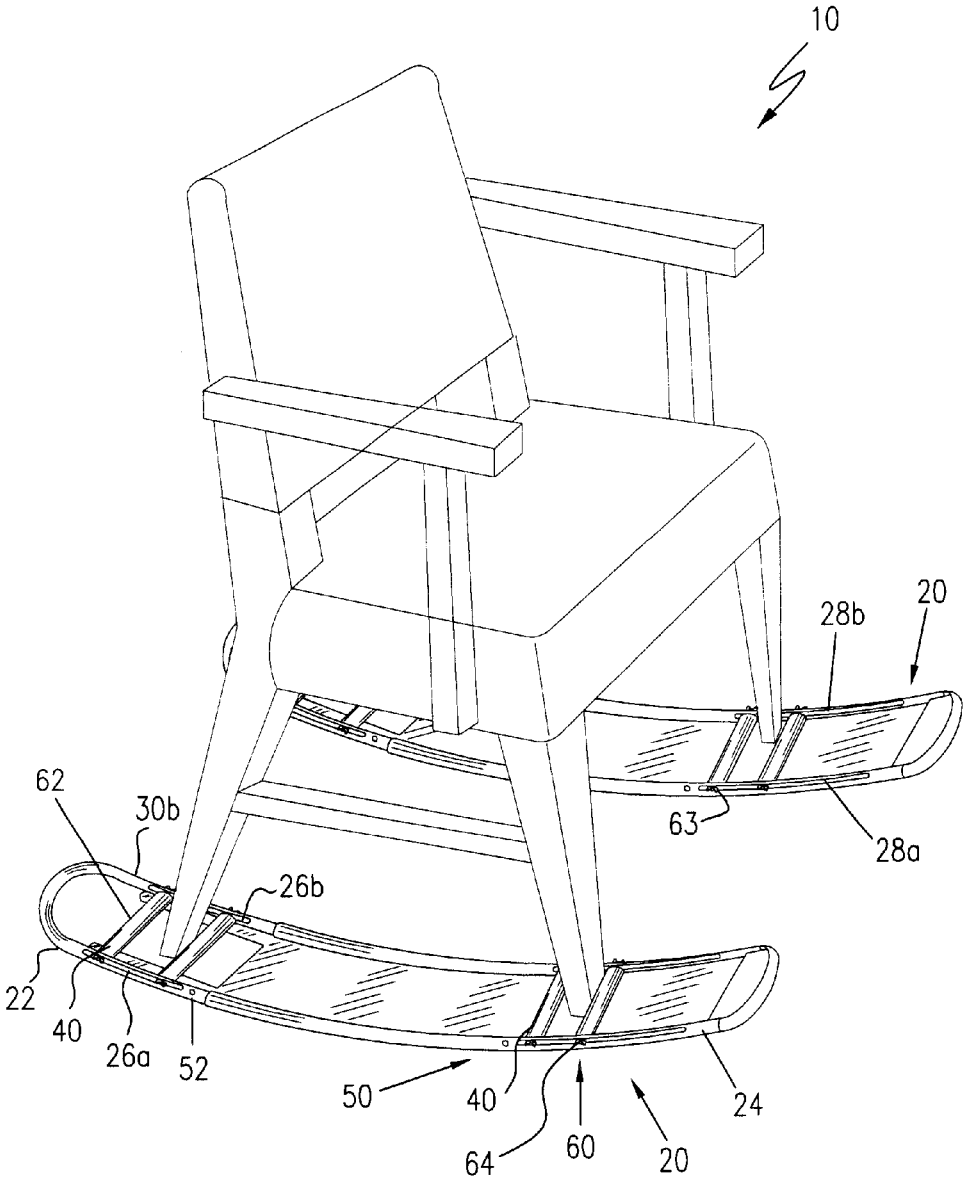
FIG. 1 is a perspective view of a portable rocking chair conversion apparatus according to the preferred embodiment of the present invention shown secured to a conventional chair.
Figure 2:
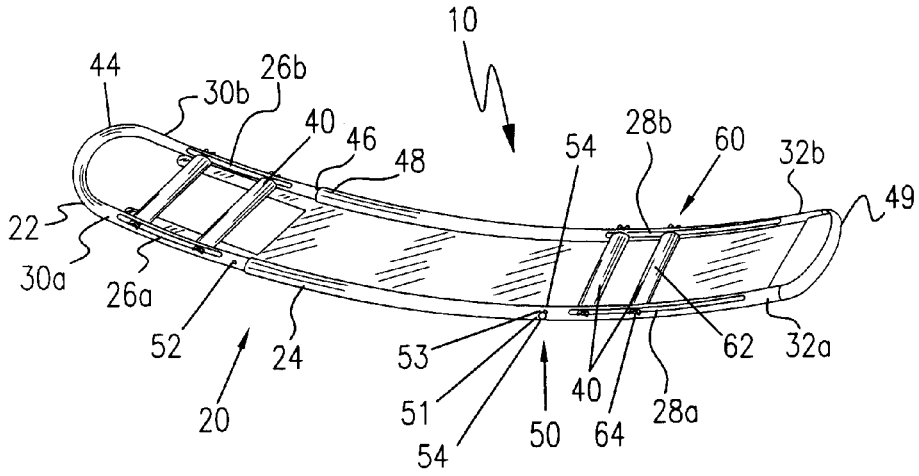
FIG. 2 is a perspective view of the portable rocking chair conversion apparatus according to the preferred embodiment of the present invention.
Figure 3:
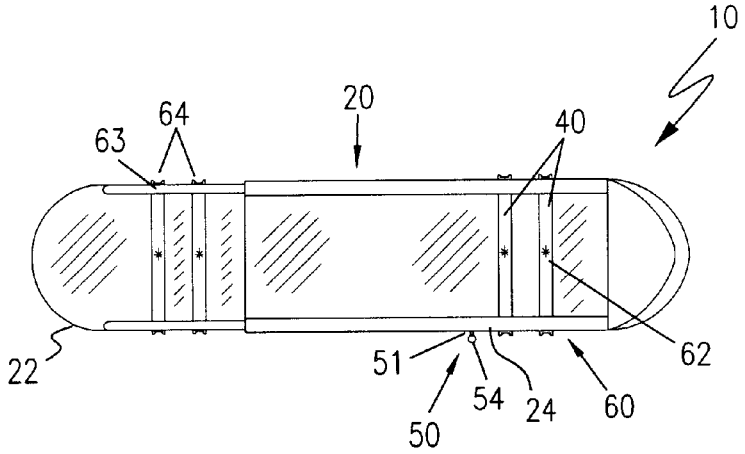
FIG. 3 is a top plan view thereof.
Figure 4:
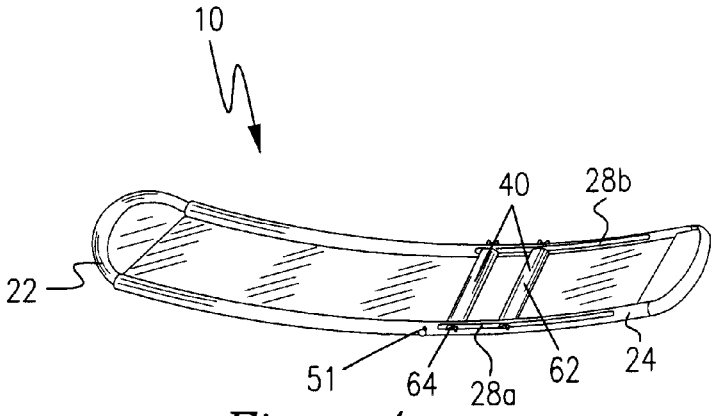
FIG. 4 is a perspective view of the portable rocking chair conversion apparatus according to the preferred embodiment of the present invention shown in a retracted position.

Referring now to FIGS. 1–4, a portable rocking chair conversion apparatus 10 is shown, according to the present invention, comprised of a pair of arcuate, cylindrical, telescoping rocking members 20 and a leg attachment means 60 which includes a plurality of impingement, cylinders 40.

Each of the pair of rocking members 20 includes a C-shaped inner member 22 telescoping inside a C-shaped outer member 24 for providing a retractable device being easily transportable.

Each inner member 22 and outer member 24 are constructed of plastic or other material capable of injection molding, and therefore can be formed easily of recycled material. Each inner member 22 and outer member 24 further having linearly elongated slots 26*a,b* and 28*a,b* respectively, formed along opposing vertical sidewalls 30*a,b* and 32*a,b* for slidably receiving ends of each of the cylinders 40 (as will be described in greater detail below).

Each of the C-shaped inner members 22 having an elongated flattened lower surface formed of plastic with an anterior end 44 opposite a posterior end 46. The anterior end 44 of the inner member 22 is curved upwardly in a bowed configuration.

Each of the C-shaped outer members 24 having an elongated flattened lower surface formed of plastic with an anterior end 48 opposite a posterior end 49. The posterior end 49 of the outer member 24 is curved upwardly in a bowed configuration.

A lower surface of the posterior end 46 of each of the inner members 22 forming a tapered portion for telescoping inside the anterior end 48 of a lower surface of each of the outer members 24, thereby providing a retractable device which is easily transportable.

Once each of the rocking members 20 has been extended from a retracted position, the inner member 20 and the outer member 24 can be held into their desired position via a spring-loaded pin assembly 50. The pin assembly 50 is designed so as to cooperate with a plurality of holes 52 aligned along a length at the posterior end 46 of the vertical sidewall 30*a* of the inner member 22.

The spring-loaded pin assembly 50 includes a spring-loaded pin 51, of a linearly elongated configuration, being located at an end of the outer member 24 which extends through a hole 53 in the outer member 24, positioned laterally, and capable of lateral movement via a spring-loaded pin handle 54.

The inner member 22, outer member 24 and the spring-loaded pin 51 are configured such that, when the spring-loaded pin 51 is in a resting position, the inner member 22 and outer member 24 are locked into position by mechanical interference between the spring-loaded pin 51 extending through a hole 53 in the outer member through a hole 52 in the inner member 22. Retraction of the spring-loaded pin 51 removes the mechanical interference, thus permitting the inner member 22 to be extended away from or retracted into the outer member 24. As such, the length of each rocker member 20 is mechanically adjustable and can provide various linear lengths.

For securely accommodating legs of a chair, a leg attachment means 60 is disclosed. The leg attachment means 60 includes a plurality of selectably adjustable impingement cylinders 40 of a linearly elongated tubular configuration. Each cylinder 40 having a frictional gripping slot 62 formed on an upper, external circumferential surface thereof for removably receiving a chair leg therein. The frictional gripping slot 62 is adapted so as to conform to and securely grip an inserted chair leg. Such design allows the frictional gripping slot 62 to grippingly receive chair legs formed not only in circular shapes having a particular diameter, but in cross-sectional shapes such as square and hexagonal having various diameters as well.

To accommodate chairs of various sizes, bolts 63 are fixedly attached at ends of each of the cylinders 40 for slidably engaging the slots 26*a,b* and 28*a,b* of each of the vertical sidewalls 30*a,b* and 32*a,b* respectfully. Ends of the cylinders 40 are operable to slide within and along a length of the slots 26*a,b* and 28*a,b*, thereby allowing for the selective adjustment of the cylinders 40 for accommodating chairs of various sizes. Fasteners 64 such as a washer followed by a wing nut are secured to the bolts 63 for locking each of the cylinders 40 in place once a desired position is provided. However, the fastener 64 disclosed here is only meant as a suggestion and is in no way limiting.

2. Operation of the Preferred Embodiment

To use the present invention, after retracting the spring-loaded pin 51 from the outer members 24 of each of the rocker members 20, the user extends each of the inner members 22 from their retracted position and releases the spring-loaded pin 51 into a hole extending through the inner member 22 once a desired position is provided. Next, the user loosens the fasteners 64 on the ends of each of the cylinders 40 to horizontally adjust the cylinders 40 for accommodating the legs of a chair. Horizontal adjustment of the cylinders 40 allows the present invention to accommodate chairs of various sizes. Once the desired positioning of the cylinders 40 is obtained, the legs of the chair are inserted within each of the frictional gripping slots 62. The frictional gripping slots 62 conform to and securely grip the inserted chair leg. Next, the user tightens the fasteners 64 to lock each of the cylinders 40 in place. The user is now ready to begin rocking in the converted rocking chair.

When deciding to transport the present invention, the user simply reverses the aforementioned steps. Once in a retracted position, the present invention provides a lightweight, portable device capable of being placed in the trunk of a motor vehicle and is easily transportable.

The use of the present invention allows a conventional chair to provide the soothing comfort of rocking in a rocking chair almost anywhere in a manner which is quick, easy and efficient.

Therefore, the foregoing description is included to illustrate the operation of the preferred embodiment and is not meant to limit the scope of the invention. As one can envision, an individual skilled in the relevant art, in conjunction with the present teachings, would be capable of incorporating many minor modifications that are anticipated within this disclosure. Therefore, the scope of the invention is to be broadly limited only by the following claims.

What is claimed is:

1. A portable rocking chair conversion apparatus comprising:

a pair of arcuate, cylindrical, telescoping rocking members; and leg attachment means affixed to each rocking member which includes a plurality of impingement cylinders for frictionally impinging against a pair of legs of a conventional chair.

2. The portable rocking chair conversion apparatus of claim 1, wherein each of the pair of rocking members includes a C-shaped inner member telescoping inside a C-shaped outer member for providing a retractable rocking member being easily transportable.

3. The portable rocking chair conversion apparatus of claim 2, wherein each inner member and outer member are constructed of plastic.

4. The portable rocking chair conversion apparatus of claim 2, wherein each inner member and outer member further having linearly elongated slots formed along opposing vertical sidewalls for slidably receiving ends of each of said impingement cylinders.

5. The portable rocking chair conversion apparatus of claim 2, wherein each of the C-shaped inner members includes an elongated flattened lower surface with an anterior end opposite a posterior end, said anterior end of said inner member curved upwardly in a bowed configuration.

6. The portable rocking chair conversion apparatus of claim 5, wherein each of the C-shaped outer members includes an elongated flattened lower surface with an anterior end opposite a posterior end, said posterior end of the outer member curved upwardly in a bowed configuration.

7. The portable rocking chair conversion apparatus of claim 6, wherein the lower surface of the posterior end of each. of the inner members forms a tapered portion for telescoping inside the anterior end of a lower surface of each of the outer members, thereby providing a retractable device which is easily transportable.

8. The portable rocking chair conversion apparatus of claim 7, further comprising a spring-loaded pin assembly designed so as to cooperate with a plurality of holes aligned along a length at the posterior end of the vertical sidewall of the inner member and configured such that once each of the rocking members has been extended from a retracted position, the inner member and the outer member can be held into their desired positions.

9. The portable rocking chair conversion apparatus of claim 8, wherein said spring-loaded pin assembly includes a spring-loaded pin of a linearly elongated configuration, being located at an end of the outer member, said pin extending through a hole in the outer member and positioned laterally, and capable of lateral movement via a spring-loaded pin handle.

10. The portable rocking chair conversion apparatus of claim 1, wherein said leg attachment means comprises a plurality of selectably adjustable impingement cylinders of a linearly elongated tubular configuration.

11. The portable rocking chair conversion apparatus of claim 10, wherein each said cylinder further comprises a frictional gripping slot formed on an upper, external circumferential surface thereof for removably receiving a chair leg therein.

12. The portable rocking chair conversion apparatus of claim 11, wherein said frictional gripping slot is adapted so as to conform to and securely grip an inserted chair leg.

* * * * *